US009743741B2

(12) United States Patent
Lim et al.

(10) Patent No.: US 9,743,741 B2
(45) Date of Patent: Aug. 29, 2017

(54) FOLDABLE COSMETIC IMPLEMENT

(71) Applicant: HCT GROUP HOLDINGS LIMITED, Central (CN)

(72) Inventors: Cindy Sean Yuei Lim, Santa Monica, CA (US); Megan Rene Langdon, Los Angeles, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 66 days.

(21) Appl. No.: 14/982,594

(22) Filed: Dec. 29, 2015

(65) Prior Publication Data

US 2016/0106195 A1 Apr. 21, 2016

Related U.S. Application Data

(63) Continuation of application No. 13/973,874, filed on Aug. 22, 2013, now Pat. No. 9,247,803.

(51) Int. Cl.

| | |
|---|---|
| ***A45D 33/26*** | (2006.01) |
| ***A45D 33/00*** | (2006.01) |
| ***A46B 5/00*** | (2006.01) |
| ***A45D 33/34*** | (2006.01) |
| ***A45D 34/04*** | (2006.01) |
| ***A46B 7/02*** | (2006.01) |
| ***A46B 9/02*** | (2006.01) |
| ***A45D 40/26*** | (2006.01) |
| *A45D 40/22* | (2006.01) |

(52) U.S. Cl.

CPC ..... *A45D 33/006* (2013.01); *A45D 33/34* (2013.01); *A45D 34/042* (2013.01); *A45D 40/262* (2013.01); *A46B 5/0041* (2013.01); *A46B 5/0045* (2013.01); *A46B 7/026* (2013.01); *A46B 9/021* (2013.01); *A45D 2040/223* (2013.01); *A45D 2040/224* (2013.01); *A45D 2040/228* (2013.01)

(58) Field of Classification Search

CPC ..... A45D 2040/233; A45D 2040/224; A45D 2040/228

USPC ..... 401/99, 100, 123, 124, 125, 126, 131; 215/244, 245; 132/317, 318, 320

See application file for complete search history.

(56) References Cited

U.S. PATENT DOCUMENTS

| | | | |
|---|---|---|---|
| 1,508,306 | A | 9/1924 | Strulson |
| 2,459,733 | A | 1/1949 | Macy |
| 4,187,607 | A | 2/1980 | Simuro et al. |
| 4,204,294 | A | 5/1980 | Halverson |
| 5,391,011 | A | 2/1995 | Gueret |
| 6,298,863 | B1 | 10/2001 | Byun |
| 7,083,354 | B2 | 8/2006 | Byun |
| 7,093,363 | B1 | 8/2006 | Kuo |

(Continued)

*Primary Examiner* — David Walczak
*Assistant Examiner* — Joshua Wiljanen
(74) *Attorney, Agent, or Firm* — Seager, Tufte & Wickhem LLP

(57) ABSTRACT

A foldable cosmetic implement may include a first portion pivotably coupled to a second portion. An applicator may be coupled to the first portion opposite a connection of the first portion to the second portion. The cosmetic implement may be movable between a stored state and an extended state. The first portion may be at least partially enclosed in a receptacle of the second portion when the cosmetic implement is in the stored state. The cosmetic implement may include a locking mechanism to retain the implement in the stored state. The locking mechanism may be actuated by squeezing first and second sides of the second portion towards each other.

11 Claims, 7 Drawing Sheets

(56) References Cited

U.S. PATENT DOCUMENTS

| | | | |
|---|---|---|---|
| 8,185,998 | B2 | 5/2012 | Xu |
| 2006/0075570 | A1 | 4/2006 | Gelfand |

FOLDABLE COSMETIC IMPLEMENT

CROSS REFERENCE TO RELATED APPLICATIONS

The present application is a continuation of U.S. patent application Ser. No. 13/973,874, filed Aug. 22, 2013, titled FOLDABLE COSMETIC IMPLEMENT, the disclosure of which is incorporated herein by reference.

BACKGROUND

A typical cosmetic brush contains a handle and an applicator attached to one end of the handle. This combination of a handle and an applicator provides a simple, low-cost and effective brush for the application of cosmetic materials.

Cosmetic brushes can vary greatly in size and shape in order to meet the differing needs of cosmetic users. Some smaller cosmetic brushes are intended to be portable and easy to carry in a handbag, pocket, or purse. However, smaller cosmetic brushes often do not have an adequately sized handle for gripping during use. When a brush is too small to achieve a sturdy grip, the user may not be able to apply the cosmetic product with the precision and control desired. Often, smaller portable brushes will be bundled, packaged, and sold with other cosmetic vessels, implements, and/or products, only to be discarded in favor of a larger, easier to grip brush.

The applicator of a cosmetic brush may comprise a plurality of bristles, a sponge, or a flocking. Proper cleaning, drying, and protection of the applicator material may be important to prolong the useful life of the cosmetic brush. Some brushes may include a cap to cover and protect the applicator. However, repeatedly sliding a cap onto the applicator may inadvertently bend or damage the applicator, especially if the applicator comprises delicate bristles. If the cap is lost, the applicator may be even more susceptible to damage. Some caps are fully enclosed to protect the applicator, trapping any remaining moisture in the applicator. If the applicator is not properly dried, it may become damaged and the useful life of the cosmetic brush may be decreased.

Accordingly, there remains a need for improved cosmetic brushes.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
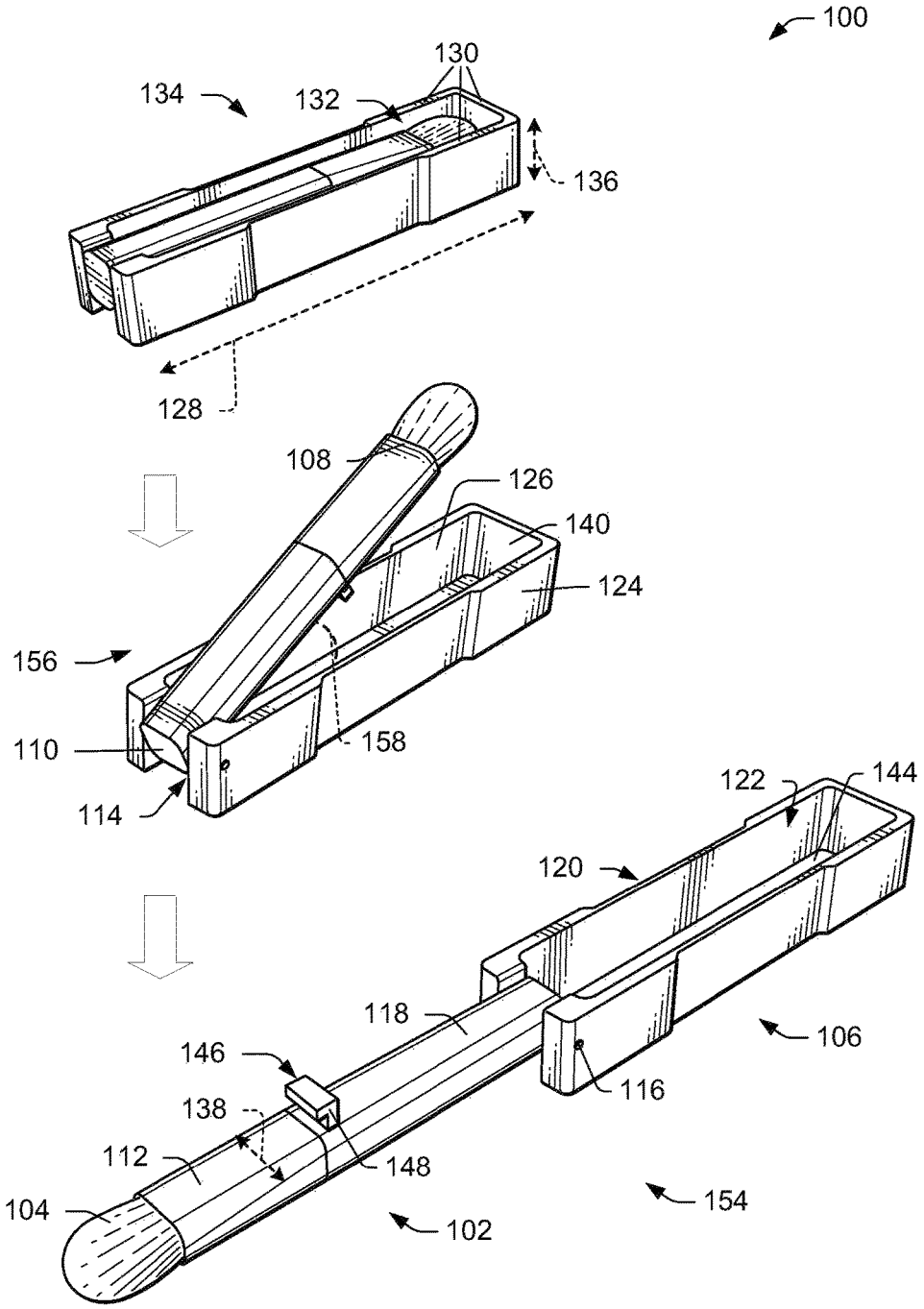
FIG. 1 is a perspective view of a first embodiment of an example foldable cosmetic implement in a stored position, an intermediate position, and an extended position.

This disclosure is directed to a foldable cosmetic implement comprising a first portion hingedly coupled to a second portion. An applicator may be coupled to an end of the first portion opposite the hinge with a ferrule or other coupling means. In some examples, the implement may be movable between a stored position and an extended position. In the stored position, the first portion may be received in a receptacle disposed on the second portion. The first portion may be released from the receptacle, for example, by squeezing a first side wall of the receptacle towards a second side wall of the receptacle, actuating a locking mechanism, depressing a release mechanism, moving a lever, or the like.

In some embodiments, the second portion may include a receptacle to house and protect the applicator. For instance, the receptacle may have a first side wall, a second side wall, a third side wall and/or a back wall that at least partially surround and prevent damage to the applicator when the implement is in the stored position. Other embodiments may omit the back wall so that the applicator may experience increased airflow for drying when the implement is in the stored position.

In some examples, the cosmetic implement may include three or more portions to allow for an even greater extension. For instance, the cosmetic implement may include a third portion coupled to the second portion. When in the stored state, the third portion may at least partially enclose the second portion which may at least partially enclose the first portion, providing a substantially compact and portable profile. The portions may be pivoted or extended until they are substantially collinear and the implement has a profile large enough to grip and use effectively.

In some embodiments, the implement may include a locking mechanism to hold the implement in the folded and/or extended positions. The locking mechanism may retain the implement in the extended position so that the implement may apply a cosmetic product without collapsing. Further, the locking mechanism may retain the implement in the folded position in a manner that is easily actuated, allowing a user to quickly and effortlessly move the implement into the extended position for use.

In some examples, the cosmetic implement may be configured to mate with another cosmetic device. For instance, a cosmetic vessel may have a mating area, such as a channel, disposed on an outer surface to mate with the cosmetic implement when the cosmetic implement is in the stored position. In such examples, the implement may be combined with the cosmetic vessel to form a single "2-in-1" unit, reducing the clutter of cosmetic devices in a user's purse and/or bathroom.

Multiple and varied example implementations and embodiments are described below. However, these examples are merely illustrative and other implementations and embodiments of a foldable cosmetic brush may be implemented without departing from the scope of the disclosure. For instance, the implementations, or portions thereof, may be rearranged, combined, used together, may omit one or more portions, and/or may be otherwise modified to arrive at variations on the disclosed implementations.

Illustrative Foldable Cosmetic Implement

FIG. 1 illustrates an cosmetic implement 100 having a first portion 102, an applicator 104, and a second portion 106. A first end 108 of the first portion 102 may be coupled to the applicator 104, and a second end 110 of the first portion 102 may be pivotably coupled to the second portion 106. In a stored position 134, the first portion 102 may be folded into the second portion 106 so the applicator 104 may be at least partially protected by the second portion 106. This configuration may allow the implement 100 to be substantially portable.

In some examples, the first portion 102 may be coupled to the applicator 104 with a ferrule 112. To effectively couple to the applicator 104, the ferrule 112 may, in some examples, include crimps, screws, rivets, fusing, gluing, magnets, snap-fits, press-fits, friction-fits, stapling, notches, or any other coupling structures and/or methods. The method of coupling the ferrule 112 to the application 104 may be configured such that the applicator 104 may be removed (e.g., snap-fits, magnets, hook-and-loop, etc.) and replaced with another applicator (not shown) of a similar or different configuration. In some embodiments, the method of coupling the ferrule 112 to the applicator 104 may be substantially immutable.

The ferrule 112 may couple to the first portion 102 using any of the aforementioned methods or combinations of methods for coupling to the applicator 104. As in the embodiments described above, the ferrule 112 may be a separate unit from the first portion 102. Alternatively, the ferrule 112 may be an extension of the first portion 102 so that the ferrule 112 and the first portion 102 comprise a single unit.

In some embodiments, the first portion 102 may be pivotably coupled to the second portion 106 with a hinge 114. The hinge 114 may comprise a pin 116 passing through the first portion 102 and at least partially passing through the second portion 106. A spring (not shown) disposed in the first portion 102 and/or the second portion 106 may provide a rotational force about the hinge 114 to bias the implement 100 toward the stored position 134 or an extended position 154.

In some examples, the implement 100 may include the applicator 104 coupled to the first end 108 of the first portion 102. The applicator 104 may comprise any material capable of retaining a cosmetic product and applying the product to a surface. For instance, the applicator 104 may be used to apply eye shadow to an eyelid, blush to a cheek, powder for facial contouring, or for applying any other type of cosmetic product. In some embodiments, the applicator 104 may comprise natural bristles (hair, cellulose fibers, cotton, hemp, flax or composites thereof), synthetic bristles (e.g. plastic, silicone, latex or composites thereof), metallic bristles, flocking, silicone, rubber, sponge, pencil, or composites thereof. In some embodiments, the applicator 104 may comprise a single material and in other embodiments it may comprise a combination of materials.

In some examples, the applicator 104 shape may be substantially rounded, as illustrated in FIG. 1. The applicator may be substantially squared, flat, slanted, rounded, beveled, pointed, curved, or any other shape. As described in greater detail above, the applicator 104 may be permanently coupled to the first portion 102 with the ferrule 112, or removably coupled to the first portion 102, such as with a hook-and-loop surface, magnet, or snap-fit.

As illustrated in FIG. 1, some examples of the cosmetic implement 100 may include the first portion 102 comprising a substantially linear shaft 118. The shaft 118 may comprise a substantially rigid or semi-rigid material such as metal, ceramic, glass, stone, wood, fiber glass, plastic, or composites thereof. The shaft 118 may be comprised of any one or a combination of the foregoing materials. The second portion 106 may comprise a handle 120 comprised of any one of or a combination of the aforementioned materials or a different material. Likewise, the ferrule 112 may comprise any one of or a combination of the aforementioned materials or a different material. The handle 120 may include a receptacle 122. In some embodiments, the receptacle 122 may be comprised of a first sidewall 124 and a second sidewall 126 substantially parallel to the first sidewall 124. The first and second sidewalls 124 and 126 may extend a length 128 of the handle 120 with edges 130 defining an opening 132 of the receptacle 122.

In some examples, the cosmetic implement 100 may be foldable into the stored position 134. In the stored position 134, the shaft 118 may be disposed in the receptacle 122 with the first and second sidewalls 124 and 126 positioned on either side of the shaft 118. In some embodiments, the applicator 104 may be at least partially enclosed by the first and second sidewalls 124 and 126. The first and second sidewalls 124 and 126 may have a height dimension 136 greater than a width dimension 138 of the shaft 118 such that the shaft 118 does not protrude from the opening 132 when in the stored position 134. This configuration may allow the sidewalls 124 and 126 to protect the applicator 104 from incurring damage when the implement 100 is transported in a purse, a pocket, or the like. In other examples, the width dimension 138 may be greater than the height dimension 136 so that the first portion may at least partially protrude from the opening 132 when the implement is in the stored position 134.

As illustrated in FIG. 1, some examples of the implement 100 may include a third sidewall 140 disposed at an end 142 of the handle 120. The third sidewall 140 may be coupled perpendicularly to the first and second sidewalls 124 and 126. The handle 120 may include a back wall 144 opposite the opening 132. In such examples, the receptacle 122 may be comprised of the first and second sidewalls 124 and 126, the third sidewall 140, and the back wall 144. In some examples, the opening 132 may remain open when the implement 100 is in the stored position 134. In other examples, a movable partition or cover (not shown) may at least partially close the opening 132 when the implement 100 is in the stored position 134.

In some embodiments, the cosmetic implement 100 may include a locking mechanism 146. FIG. 1 illustrates one embodiment of locking mechanism 146 that includes a flange 148 protruding from the first portion 102. In some examples, the flange 148 may mate with a receiving member or slot when the implement 100 is in the stored position 134, retaining the implement 100 in the stored position 134. In such examples, the locking mechanism 146 may be actuated to release the implement 100 into the extended position 154 by squeezing the first sidewall 124 towards the second sidewall 126 to partially deform the locking mechanism 146 or receiving member. In some examples, this action may be assisted by a force provided by, for example, spring-loaded hinge 114. Many other embodiments of the locking mechanism 146 may be implemented and are discussed in further detail below.

Figure 2:
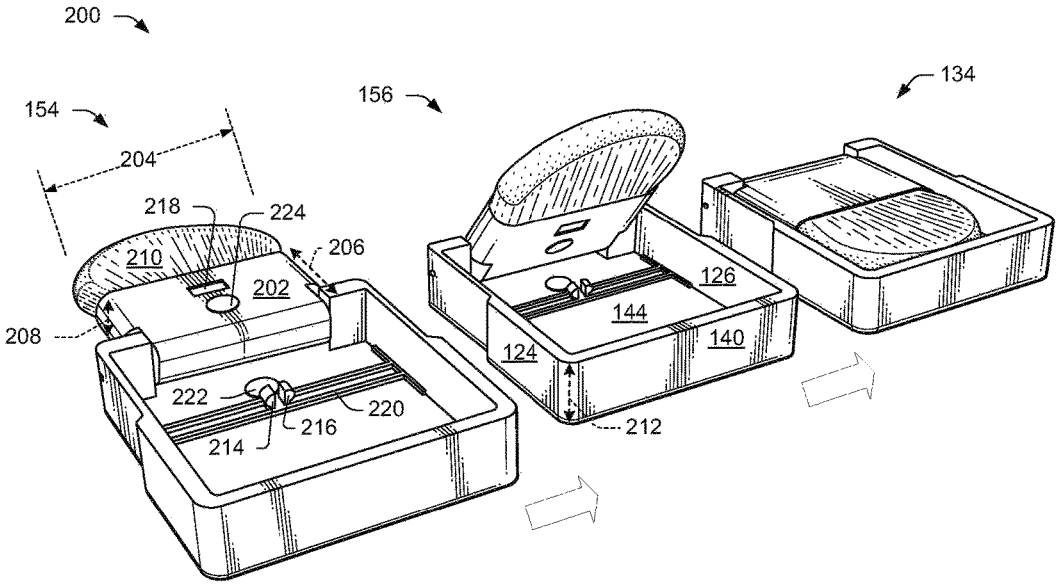
FIG. 2 is a perspective view of a second embodiment of an example foldable cosmetic implement in a stored position, an intermediate position, and an extended position.

FIG. 2 illustrates another exemplary embodiment of a cosmetic implement 200 comprising the first portion 102, the applicator 104, and the second portion 106. In some examples, the first portion 102 may comprise a substantially rectangular body 202. The body 202 may have a length dimension 204 and a height dimension 206 substantially greater than a width dimension 208 so that the body 202 has a substantially flat planar profile.

As shown in FIG. 2, the cosmetic implement 100 may have the applicator 104 coupled to the body 202. The applicator 104 may comprise a sponge 210, or any other material capable of retaining a cosmetic product and applying said product to a surface as disclosed in greater detail above. The sponge 210 may comprise a substantially planar semi-circle coupled directly to the body 202, as illustrated in FIG. 2, or any other suitable shape. The sponge 210 may be coupled to the body permanently or removably by any of the attachment mechanisms described above. The second portion 106 of the implement 100 illustrated in FIG. 2 may include the receptacle 122 defined by at least the first sidewall 124 and the second sidewall 126. The receptacle 122 may be further defined by third sidewall 140 and/or back wall 144, with top edges 130 defining the opening 132. The first, second, and third sidewalls 124, 126, and 140 may have a height dimension 212 greater than the width dimension 208 of the body 202 so that the body 202 is entirely below the opening 132 defined by the top edges 130 when the implement is in the stored position 134. As shown in FIG. 2, the second portion 106 may have a substantially square shape. However, the second portion 106 may have a rectangular shape, circular shape, or any other shape configured to receive the first portion 102.

In some examples, the first portion 102 may be retained in the receptacle 122 when the implement 100 is in the stored position 134 by locking mechanism 146. As illustrated in FIG. 2, locking mechanism 146 may comprise a first tab 214 and a second tab 216 positioned next to the first tab 214. The first and second tabs 214 and 216 may be disposed on the back wall 144 extending towards the opening 132. An aperture 218 may be disposed on the first portion 102 for receiving the first and second tabs 214 and 216 when the implement 100 is in the stored position 134. The locking mechanism 146 may further comprise a compression bar 220 coupled to the first and second tabs 214 and 216 that extends along the back wall 144 towards the first and second sidewalls 124 and 126. In such examples, the implement 100 may be released from the stored position 134 by squeezing the first and second side walls 124 and 126 together which compresses the compression bar 220 and moves the first tab 214 towards the second tab 216. With the first tab 214 moved towards the second tab 216, the aperture 218 is free to slide past the first and second tabs 214 and 216 and the implement 100 is free to move from the stored position 134 to the extended position 154.

In some embodiments, a force may be provided to direct the implement 100 into the extended position 154 when the locking mechanism 146 is actuated and released. For instance, the hinge 114 may be spring loaded with a coiled spring, a multi-arm spring, a living hinge, or any other type of spring mechanism. The spring may be external to the first portion 102 and/or the second portion 106, or the spring may be internal to the first portion 102 and/or the second portion 106. In some examples, the force may be provided by a first magnet 222 disposed on the first portion 102 and a second magnet 224 disposed on the second portion 106. The first magnet 222 and the second magnet 224 may have like-polarized sides facing each other such that the first and second magnets 222 and 224 generate a repulsive force when in proximity to each other. Alternatively, first and second magnets 222 and 224 may have opposite polarities facing each other such that the magnets 222 and 224 may function as the locking mechanism 146.

The force imparted by the spring, magnets 222 and 224, and/or any other force imparting feature may provide a "popping" or "springing" action, wherein the implement 100 quickly and automatically moves from the stored position 134 to the extended position 154 when the locking mechanism 146 is actuated, similar to the action of a spring-loaded, or "switch" blade. The implement 100 may have a single force providing feature, multiple force providing features, or, in other examples, the implement 100 may omit the force providing feature.

In some embodiments, the implement 100 may be movable to an intermediate position 156 between the stored position 134 and the extended position 154. When in the intermediate position 156, the first portion 102 may form an angle 158 with the second portion 106, the angle 158 being less than 180.degree. In some examples, the locking mechanism 146 may be used to retain the implement 100 in the intermediate position 156, or a different locking mechanism (not shown) may be used.

In some examples, other types of locking mechanisms 146 may be implemented. For instance, the first magnet 222 disposed on the first portion 102 and the second magnet 224 disposed on the second portion 106 may have opposite polarities facing each other such that the first and second magnets 222 and 224 generate an attractive force when in proximity to each other. In some examples, a ferrous metal may be disposed on the first portion 102 or the second portion 106 to generate an attractive force with the first magnet 222. In some examples, the locking mechanism 146 may comprise a latch, a snap-fit, a hook surface and a corresponding loop surface (e.g., Velcro), etc. The locking mechanism 146 may comprise a friction fitting which may be actuated by squeezing the first sidewall 124 towards the second sidewall 126. In some examples, multiple locking mechanisms may be used simultaneously, or, in other examples, the locking mechanism 146 may be omitted.

In some embodiments, a second locking mechanism (not shown) may be used to retain the implement 200 in the extended position 154 in addition to, or alternatively to, the first locking mechanism 146. The second locking mechanism may be substantially similar to or substantially different than the first locking mechanism 146. In some examples, the second locking mechanism may comprise at least a portion of the first locking mechanism 146.

Figure 3:
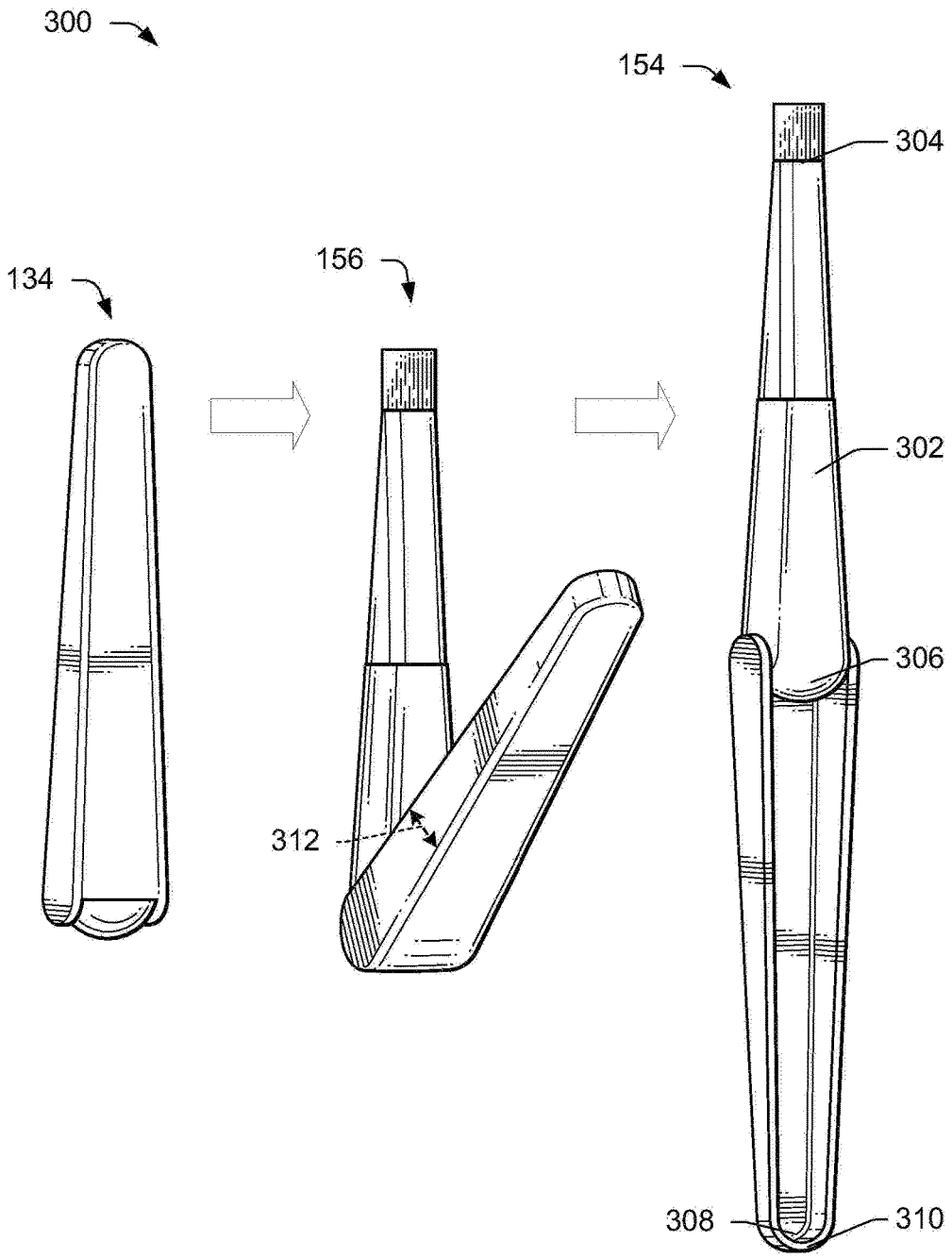
FIG. 3 is a perspective view of a third embodiment of an example foldable cosmetic implement in a stored position, an intermediate position, and an extended position.

FIG. 3 illustrates another exemplary embodiment of a cosmetic implement 300. In some examples, implement 300 may comprise first portion 102 having a tapered shaft 302 with a narrow end 304 coupled to the applicator 104 and a wide end 306 coupled to the second portion 106. In some examples, the narrow end 304 may couple to the applicator 104 via the ferrule 112. Possible implementations of the ferrule 112 are described in greater detail above. Alternatively, the tapered shaft 302 may couple directly to the applicator 104.

In some examples, the second portion 106 may comprise the receptacle 122 having first and second sidewalls 124 and 126. As shown in FIG. 3, the first and second sidewalls 124 and 126 may taper towards each other, connecting at an end 308 opposite the hinge 114 with a loop wall 310. In some embodiments, the first and second sidewalls 124 and 126 may have a height dimension 312 that tapers towards the end 308 such that the height dimension 312 is greatest near the hinge 114 and smallest near the end 308. The receptacle 122 may be further defined by the back wall 144 coupled to the first sidewall 124, the second sidewall 126, and the loop wall 310.

In some embodiments, the tapered shape of the second portion 106 may be configured to align with the tapered shape of the first portion 102 such that the first portion 102 may rest in and be at least partially enclosed by the second portion 106 when the implement 100 is in the stored position 134. The first portion 102 may be disposed entirely below the opening 132 when the implement 100 is in the stored position 134. In other embodiments, the first portion may be disposed partially below the opening 132 when the implement 100 is in the stored position 134. In some examples, the tapered profile may provide a more ergonomic shape for gripping, allowing for greater precision when applying a cosmetic product to a face.

Figure 4:
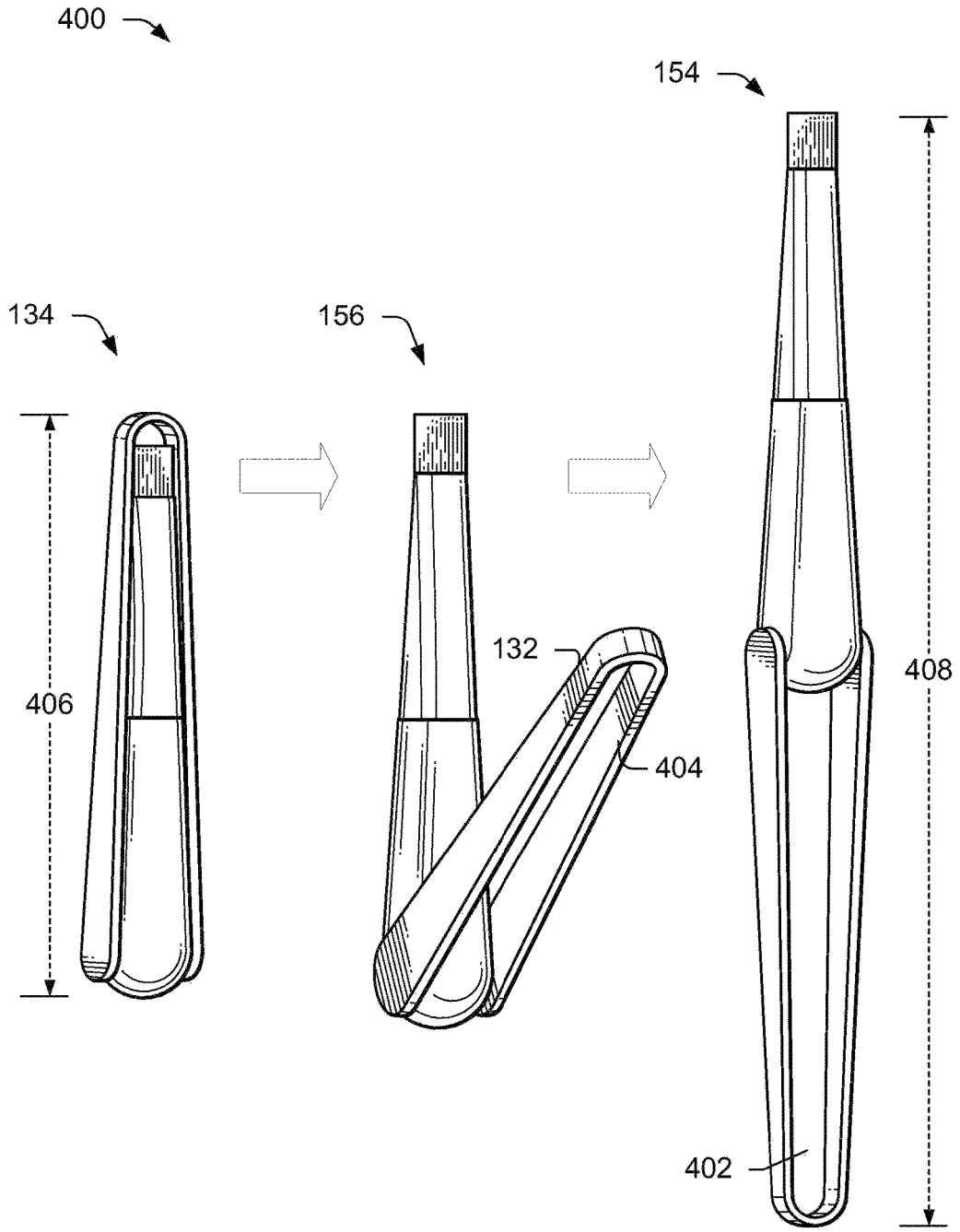
FIG. 4 is a perspective view of a fourth embodiment of an example foldable cosmetic implement in a stored position, an intermediate position, and an extended position.

FIG. 4 illustrates another exemplary embodiment of a cosmetic implement 400. In some examples, the second portion 106 may comprise a gap 402 defined by first sidewall 124 and second sidewall 126. The gap 402 may be open at the end 308 or, as illustrated in FIG. 4, closed by the loop wall 310.

In some examples, when the implement 400 is in the stored position 134, the first portion 102 may be at least partially positioned in the gap 402 between the first and second sidewalls 124 and 126. The gap 402 may include the opening 132 as well as a second opening 404 opposite the first opening 132. In some embodiments, having first and second openings 132 and 404 may provide greater airflow through the implement 400 so that the applicator 104 may continue to dry while in the stored position 134. In some examples, when the implement 100 is moved from the stored position 134 to the extended position 154, the first portion may rotate through either the first opening 132 or the second opening 404. For instance, the second portion 124 may be rotatable in multiple directions.

FIGS. 1-4 illustrate exemplary embodiments of the cosmetic implement 100 comprising the first portion 102, the applicator 104, and the second portion 106. In some examples, the implement 100 may have a first length dimension 406 in the stored position 134 and a second length dimension 408 in the extended position 154. In embodiments such as those illustrated in FIGS. 1-4, the second length dimension 408 may be substantially double the first length dimension 406. In other examples, the second length dimension 408 may be less than double the first length dimension 406, but still greater than the first length dimension 406. For instance, the second length dimension 408 may be between about 50% and 100% greater than the first length dimension 406.

Illustrative Foldable Cosmetic Implement with Three Portions

Figure 5:
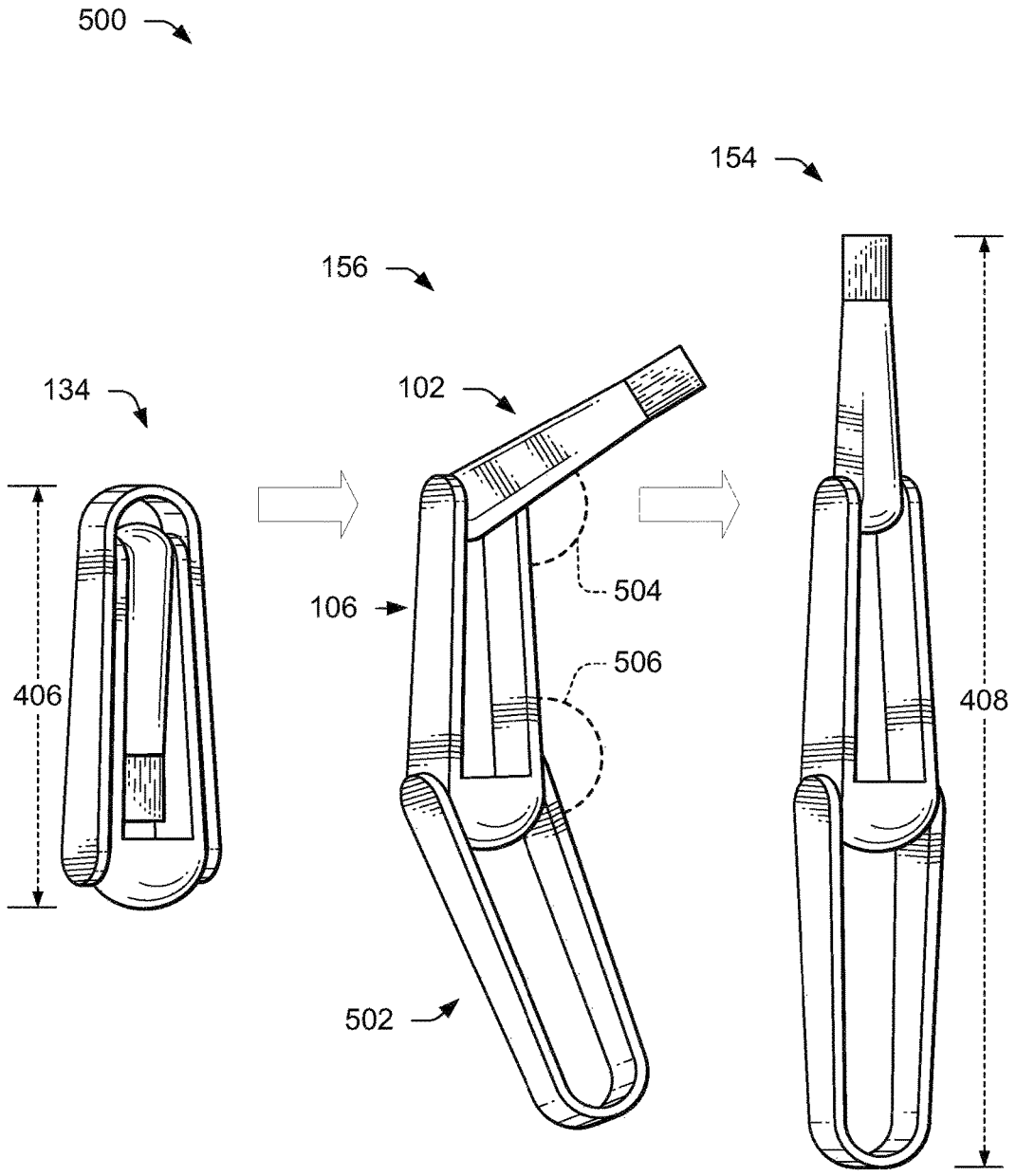
FIG. 5 is a perspective view of a fifth embodiment of an example foldable cosmetic implement in a stored position, an intermediate position, and an extended position.

Turning now to FIG. 5, an exemplary embodiment of a cosmetic implement 500 comprising the first portion 102, the applicator 104, the second portion 106, and a third portion 502 is shown. In some examples, any of the features, elements, and/or characteristics disclosed above may apply to the implement 500 illustrated in FIG. 5. The third portion 502 may provide greater extendibility and/or portability for the implement 500.

In some embodiments, the third portion 502 may be coupled to the end 142 of the second portion 106 opposite the hinge 114 in a manner similar to which the second portion 106 is coupled to the first portion 102, described above. A single locking mechanism 146 or multiple locking mechanisms (not shown) may be used.

In some examples, when the implement 500 is in the stored position 134, the third portion 502 may at least partially enclose the second portion 106, which at least partially encloses the first portion 102. The implement 500 may be movable to the extended position 154 by rotating the third portion 502 relative to the second portion 106 and rotating the second portion 106 relative to the first portion 102. In some embodiments, the implement 500 may be held in the extended position 154 with the second locking mechanism (not shown) when the first, second, and third portions 102, 106, and 502 are substantially co-linear.

In some examples, the implement 500 may be retained in the intermediate position 156 wherein the first portion 102 and the second portion 106 form a first angle 504 and/or the second portion 106 and the third portion 502 form a second angle 506, at least one of the angles 504 and 506 being less than 180.degree. The implement 500 may be retained in the intermediate position 156 via the first locking mechanism 146 and/or the second locking mechanism.

In some embodiments, the implement 500 may have the first length dimension 406 in the stored position 134 and the second length dimension 408 in the extended position 154. As shown in FIG. 5, the second length dimension 408 may be substantially three times the first length dimension 406. In other examples, the second length dimension 408 may be greater than the first length 406 dimension, but less than three times the first length dimension 406.

Figure 6:
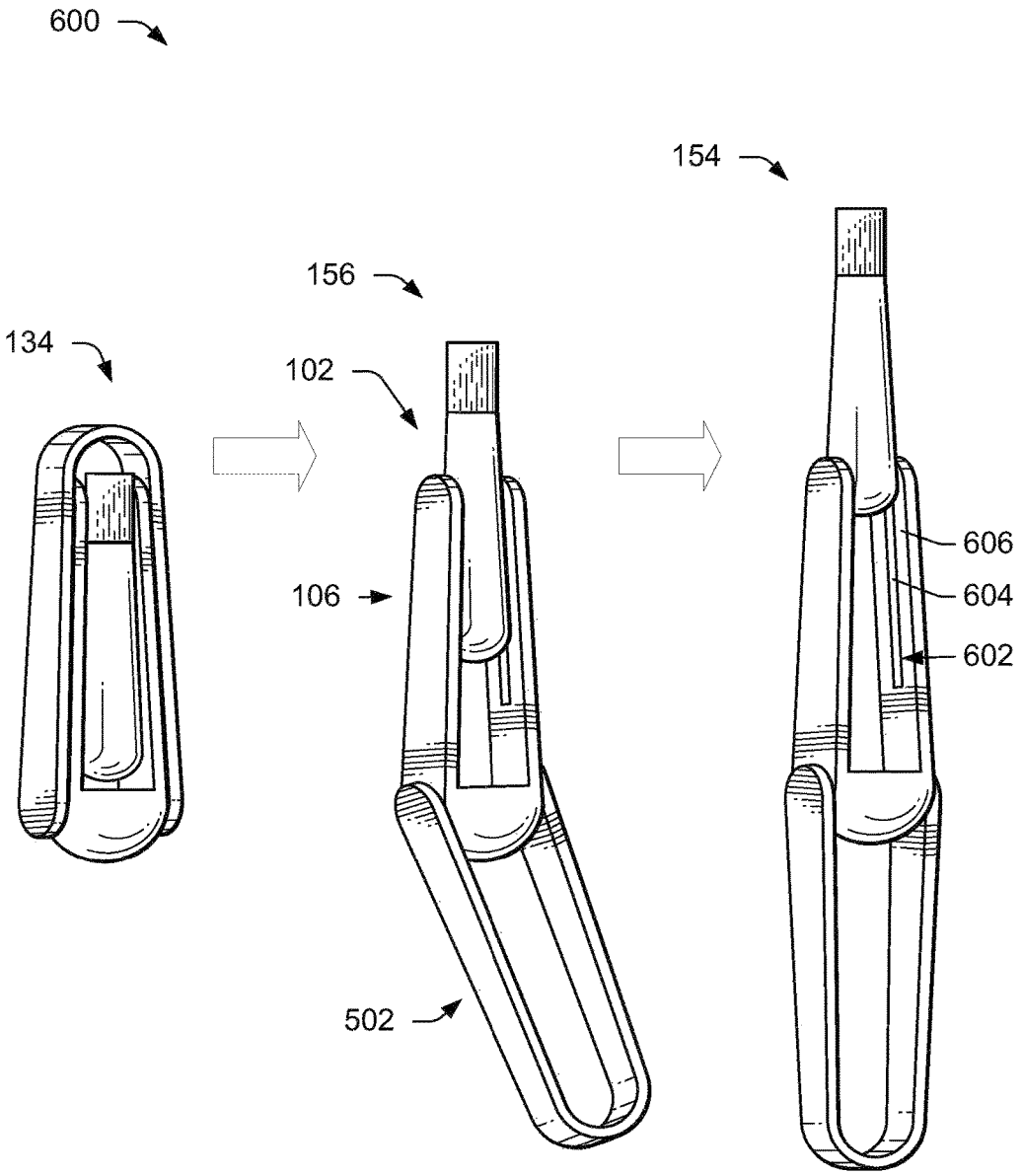
FIG. 6 is a perspective view of a sixth embodiment of an example foldable cosmetic implement in a stored position, an intermediate position, and an extended position.

FIG. 6 illustrates another exemplary embodiment of a cosmetic implement 600 comprising the first portion 102, the applicator 104, the second portion 106, and the third portion 502, wherein the implement 600 may be movable to an extended position by pivoting the third portion 502 relative to the second portion 106 and sliding the first portion 102 relative to the second portion 106.

In some examples, the sliding motion may be guided by a sliding mechanism 602 comprising a channel 604 disposed on an internal surface 606 of the second portion 106. The sliding mechanism 602 may also comprise a corresponding tab (not shown) which may protrude from the first portion 102 and be received in the channel 604. The tab-channel configuration may allow the first portion 102 to slide substantially linearly away from the second portion 106 when the implement 600 is moved into the extended position 154 and substantially linearly towards the second portion 106 when the implement 600 is moved into the stored position 134. Some examples may include a locking mechanism (not shown) to maintain the first portion 102 in the extended position 154 and/or the stored position 134. The locking mechanism may be a feature of the sliding mechanism 602 or it may be separate from the sliding mechanism 602. Although the sliding mechanism 602 is described as having a tab-channel configuration, many other sliding mechanisms may be implemented.

In some embodiments, the third portion 502 may slide relative to the second portion 106 using the sliding mechanism 602 described above. The third portion 502 may be slidable relative to the second portion 106 in addition to or alternatively to the first portion 102 being slidable relative to the second portion 106.

Although embodiments with two portions and three portions are illustrated in the figures, implement 100 may include more than three portions, such as a fourth portion (not shown). In such an example, the second length dimension 408 may be substantially four times the first length dimension 406. In some embodiments, the ratio of the second length dimension to 408 to the first length dimension 406 may correlate to the number of portions.

Illustrative System with Foldable Cosmetic Implement

Figure 7A:
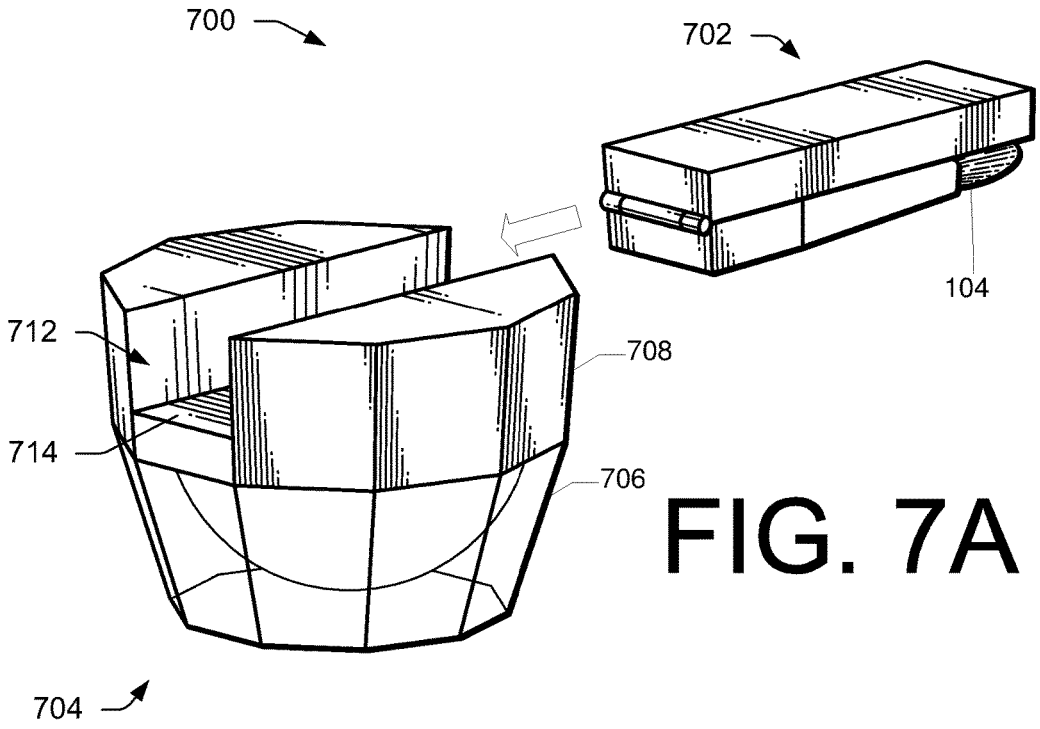
FIG. 7A is a perspective view of an example system comprising an example foldable cosmetic implement separate from an example cosmetic vessel configured to receive the foldable cosmetic implement.
Figure 7B:
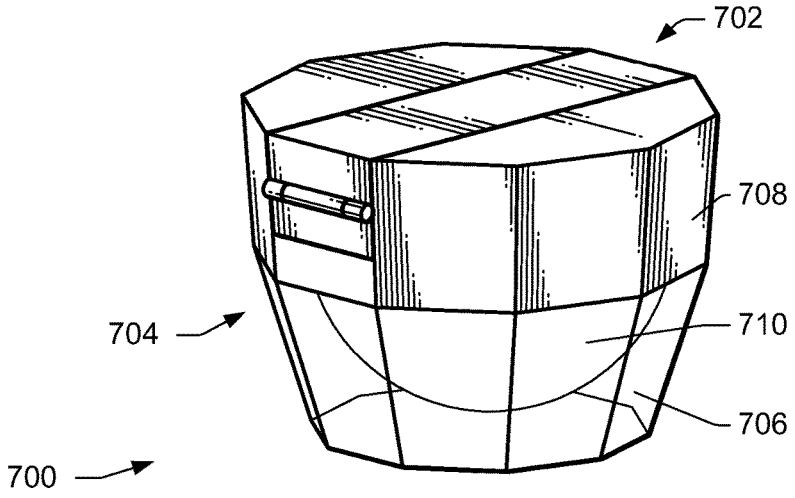
FIG. 7B is a perspective view of the system of FIG. 7A with the foldable cosmetic implement mated with the cosmetic vessel.

FIGS. 7A and 7B illustrate a system 700 comprising a cosmetic implement 702 and a cosmetic vessel 704 configured to receive the implement 702. In some examples, the vessel 704 may comprise a base 706 and a cover 708. A pot 710 may be disposed within the base 706 for containing a cosmetic product (not shown). In some embodiments, the pot 710 and/or the base 706 may comprise a transparent or translucent material so that the cosmetic product within may be externally viewed. When attached, the implement 702 may form part of an outer surface of the vessel 704 and cover 708. That is, the system 700 may have a continuous outer profile comprised in part of the vessel 704 and in part of the implement 702.

In some embodiments, the vessel 704 may have a mating area 712 configured to receive and mate with the implement 702. For instance, the mating area 712 may comprise a channel 714 in the cover 708 having a substantially similar profile as the implement 702 so that the implement 702 may fit into the channel 714. A retention mechanism (not shown) may be used to hold the implement 702 in the mating area 712. By way of example and not limitation, the retention mechanism may comprise a push-button tab, hook-and-loop surface, coupling magnets, slide channel, tab-and-aperture, detent retention mechanism, or the like.

In some embodiments, the applicator 104 of the implement 702 may be at least partially protected by the vessel 704 when the implement 702 is mated to the vessel 704. For instance, at least a portion of the applicator 104 may be sandwiched between the second portion 106 of the implement 702 and the mating area 712 of the vessel 704 when the implement 702 is mated to the vessel 704. This may be in addition to protection provided by the second portion 106.

In some examples, the implement 702 may mate to the base 706 of the vessel 704 in a manner similar to the manner in which the implement 702 is shown to mate to the cover 708. In some embodiments, the implement 702 may mate to any device or product having the mating area 712 configured to receive the implement 702. For instance, the implement 702 may mate to a compact, cosmetic kit, cosmetic bag, color pallet, hair brush, purse, another implement, and/or any other type of cosmetic device.

Conclusion

Although this disclosure uses language specific to structural features and/or methodological acts, it is to be understood that the scope of the disclosure is not necessarily limited to the specific features or acts described. Rather, the specific features and acts are disclosed as illustrative forms of implementation.

What is claimed is:

1. A combination cosmetic container and cosmetic implement comprising:

a base having a pot therein for containing a cosmetic product;

a cover for use with the base, the cover having a slot therein and an upper surface; and a cosmetic implement having first and second sections hingedly attached to one another at a hinge location, the first section having a first side with a top surface, and the second section having a first end at the hinge location and a second end having an applicator thereon, the applicator attached to the second section at a second end thereof with an application portion extending therefrom;

wherein the slot is configured to receive and mate with the cosmetic implement by insertion of the cosmetic implement hinge-first into the slot, and the upper surface of the cover and top surface of the first section form a single continuous outer profile.

2. The combination cosmetic container and cosmetic implement of claim 1 wherein the cosmetic implement comprises a hinge at the hinge location which is visible when placed in the slot.

3. The combination cosmetic container and cosmetic implement of claim 1 wherein the applicator is a brush having bristles attached at the first end of the second section and extending therefrom, the bristles each having an attached end and a free end, wherein the cosmetic implement is configured to slide into the slot such that the attached ends of the bristles enter the slot before the free ends thereof.

4. The combination cosmetic container and cosmetic implement of claim 1 wherein the slot comprises a retention mechanism for holding the cosmetic implement therein.

5. The combination cosmetic container and cosmetic implement of claim 4 wherein the retention mechanism is a push-button tab.

6. The combination cosmetic container and cosmetic implement of claim 4 wherein the retention mechanism is a hook and loop surface.

7. The combination cosmetic container and cosmetic implement of claim 4 wherein the retention mechanism includes a coupling magnet.

8. The combination cosmetic container and cosmetic implement of claim 4 wherein the retention mechanism is a slide channel.

9. The combination cosmetic container and cosmetic implement of claim 4 wherein the retention mechanism is a tab for insertion in an aperture of the cosmetic implement.

10. The combination cosmetic container and cosmetic implement of claim 4 wherein the retention mechanism is an aperture for receiving a tab of the cosmetic implement.

11. The combination cosmetic container and cosmetic implement of claim 4 wherein the retention mechanism is a detent.

* * * * *